US005487651A

United States Patent [19]

Guentert et al.

[11] Patent Number: 5,487,651

[45] Date of Patent: Jan. 30, 1996

[54] FUEL INJECTION PUMP FOR INTERNAL COMBUSTION ENGINES

[75] Inventors: Josef Guentert, Gerlingen; Hans Brett, Bietigheim-Bissingen, both of Germany

[73] Assignee: Robert Bosch GmbH, Stuttgart, Germany

[21] Appl. No.: 220,650

[22] Filed: Mar. 31, 1994

[30] Foreign Application Priority Data

Mar. 31, 1993 [DE] Germany ..... 43 10 457.6

[51] Int. Cl.[6] ..... F02M 59/26

[52] U.S. Cl. ..... 417/499; 123/500

[58] Field of Search ..... 417/494, 499; 123/500

[56] References Cited

U.S. PATENT DOCUMENTS

| | | | |
|---|---|---|---|
| 4,881,506 | 11/1989 | Hoecker | 123/500 X |
| 5,097,812 | 3/1992 | Augustin | 417/494 X |
| 5,219,280 | 6/1993 | Yashiro | 417/499 |
| 5,396,871 | 3/1995 | Faupel et al. | 417/494 X |

FOREIGN PATENT DOCUMENTS 2246056 4/1974 Germany .

*Primary Examiner*—Richard E. Gluck
*Attorney, Agent, or Firm*—Edwin E. Greigg; Ronald E. Greigg

[57] ABSTRACT

A fuel injection pump for internal combustion engines having a pump piston guided in a cylinder liner and defining in the cylinder liner a pump work chamber, which piston cooperates with a control opening in the wall of the cylinder liner to control the high pressure delivery. To control the supply onset, the pump piston has on its face end three control edges offset from each other along the length of the piston; a zero supply quantity region is provided between the first control edge, which controls a very early supply onset, and the remaining control edges. The control of the end of supply is achieved via an oblique control recess in the piston jacket face, which recess communicates with the pump work chamber, and which is embodied by two oblique grooves, which are offset from each other, whose edges toward the pump work chamber form a first oblique control edge, and a second oblique control edge separated from the first oblique edge by a shoulder; the distance between the second oblique control edge and the second face-end control edge disposed above it in the region of the shoulder is less than the diameter of the control opening, so that a zero supply quantity region is formed without sharply reducing the control path region on the pump piston.

5 Claims, 2 Drawing Sheets

FUEL INJECTION PUMP FOR INTERNAL COMBUSTION ENGINES

BACKGROUND OF THE INVENTION

The invention is based on a fuel injection pump as defined hereinafter. In a fuel injection pump of this type, known from German Offenlegungsschrift DE-OS 2 246 056, in which a pump piston defines a pump work chamber with its face end and is moved axially in a cylinder lining, the control edge that, by overtaking a control opening disposed in a cylinder wall, controls the injection onset and that is located on the face end of the pump piston in the rotary position region of the pump piston, which region controls the rated load range of the engine to be supplied, is slanted toward the control opening in such a way that the injection onset in this region is shifted to a later onset. Besides enabling optimization of the injection onset for the high-load range, this makes possible a high maximal combustion pressure in the pump work chamber in the other operating points as well, since these can now be adapted independently of the rated load range.

Consequently, the known fuel injection pump allows an increase of the maximal combustion pressure over the entire operating range of the fuel injection pump, without exceeding the maximal permissible limit value for the mechanical loading capacity of the parts, primarily in the rated load range.

In the design of the known fuel injection pump for emissions-optimized internal combustion engines, however, the injection onsets must be delayed so late that, when the engine is cold, in the lowest load range, or at zero load, white smoke is emitted, which raises the pollutant emission of the engine to be supplied when it is in this state.

In order, however, to be able to shift the injection onsets to an early enough time for an optimal and low-polluting combustion even for a "cold start", a fuel injection pump is known from a German patent application Serial No. P 42258030, which at this point in time is not published and which corresponds with U.S. Pat. No. 5,396,871 in which the control edge on the face end of the pump piston that controls the supply onset is divided into two regions separated by a longitudinal groove, of which one region, which is disposed in the partial-load zone, makes possible a very early supply onset, while the second region has a control edge offset toward the "late" direction and in which a further indentation is disposed, which forms a third control edge with which a further delay of the supply onset is possible in the range of large fuel supply quantities, so that with this fuel injection pump, an optimal adaptation of the supply onset to the different operating ranges can be achieved, even in a "cold start" of the engine.

This last aforementioned fuel injection pump has the disadvantage, however, that by means of the longitudinal groove, which serves as a stop groove between the control edge regions and which divides the very early supply onset region from the total control path region, the usable control path at the pump piston remaining for "normal operation", that is apart from a cold start, is narrowed so that the fuel injection system is no longer accurately controllable in all operating ranges. This narrowing of the usable control path leads to marked "partial supply quantity dropoffs"; that is, a very narrow control path of the control rod, which continues on the pump piston as the torsional path, causes sudden major changes in supply quantity. These sudden fluctuations in supply quantity, as they occur in the known fuel injection pump, primarily at the transition region between the very early supply onset and the stop groove, cause a fluctuation in engine speed, which can lead to self-reinforcement of the fluctuation in the entire system and thus to the familiar "seesaw effect" or intermittent racing in the engine.

OBJECT AND SUMMARY OF THE INVENTION

The fuel injection pump according to the invention has the advantage that, by suitably designing the control edges that control the supply onset and the end of supply, or their spacing apart from one another, as a function of the size of the control opening in the cylinder liner which cooperates with them, a longitudinal groove between the very early supply onset region and the remaining regulating region can be dispensed with, so that a larger usable total control path can be achieved. The zero supply necessary for regulation, between the early supply onset region for "cold starting" and the remaining supply onset region used in normal operation of the engine, is achieved as the face-end control edge which controls the supply onset does not completely close the control opening in the cylinder wall until the oblique groove on the pump piston, which controls the end of supply, has already opened the control opening once again, so that high pressure cannot build up in the pump work chamber. The embodiment according to the invention of the offset sloping control edge has the advantage that the transition between the early supply onset region and the zero supply quantity region is not abrupt, so that the effective stroke of the fuel injection pump can be controlled even in this region.

The offset course of the sloping control edge on the pump piston can be easily fabricated as regards manufacturing technics by means of two oblique grooves advantageously offset from one another, which overlap each other in the transition region, that is, at the shoulder of the sloping control edge.

Moreover, to additionally improve the regulatability of the individual operating ranges, the slopes of both control edge regions or oblique grooves are embodied differently.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
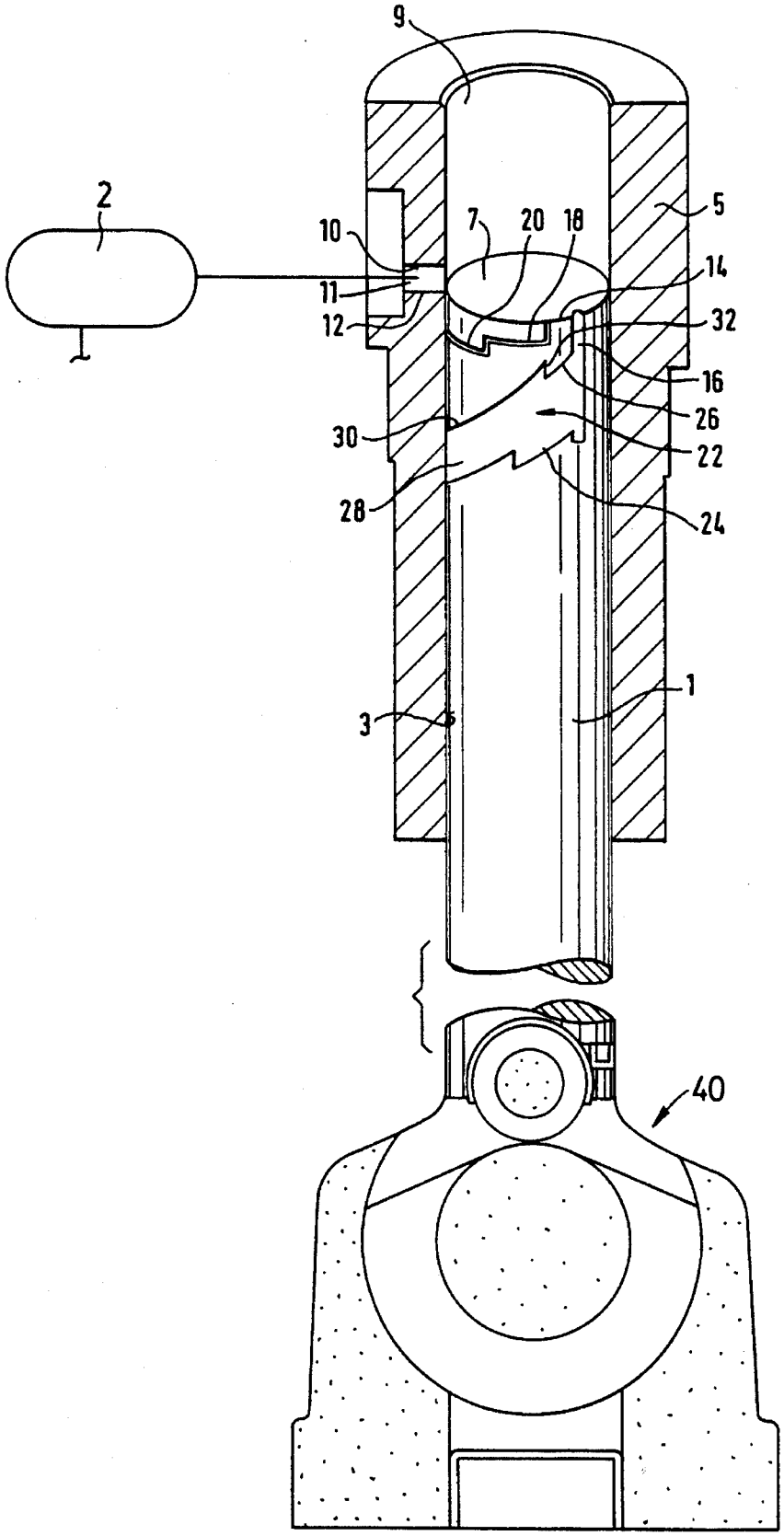
FIG. 1 shows a detail of the fuel injection pump according to the invention including a cam drive for driving the pump piston.

In the fuel injection pump, of which FIG. 1 shows only the parts important to the invention, a pump piston 1 is driven axially back and forth by a cam drive 40 in a cylinder liner 5 inserted in a pump housing. With its face end 7 remote from the cam drive, the pump piston 1 defines a pump work chamber 9 in the cylinder bore 3 that during a part of the piston stroke communicates with a low pressure chamber 2 filled with fuel that surrounds the cylinder liner 5 by means of a radial control opening 11 in the cylinder liner 5. Seen from the longitudinal axis of the pump piston, the radial control opening 11, with its outlet edge, forms an upper control edge 10 and a lower control edge 12, both of which cooperate with the pump piston 1.

The edge produced at the transition between the face end 7 of the pump piston 1 and its jacket face is embodied as a control edge, which is divided into several control edge regions. A first control edge 14 is embodied directly by means of the edge between the face end 7 and the piston jacket face. This first control edge 14 on the face end is circumferentially defined on the side remote from the control opening 11 by a longitudinal piston groove 16, and on its end remote from the longitudinal groove 16 it has a region that is recessed toward the drive end of the piston 1 in the direction of the piston's longitudinal axis, and whose defining edge runs parallel to the first control edge 14 and forms a second face-end control edge 18, which, for its part, has a further region that is recessed toward the drive end of the pump piston 1, and which forms a third face-end control edge 20.

To form a further graduation of the course of injection, it is also possible to embody the second and third control edge 18, 20 as sloping circumferentially to the radial plane of the pump piston 1.

For purposes of injection control, the pump piston 1 can be rotated via a control rod, likewise not shown, and has a control recess 22 on its jacket face that cooperates with the control opening 11; this recess is formed by two offset, crisscrossing oblique grooves, of which a first oblique groove 24 leads from the longitudinal groove 16 and, around its circumference toward the control opening 11, drops toward the drive end of the pump piston 1 below each face-end control edge 14, 18, 20; the first oblique groove 24 is defined on the pump work chamber side by a first oblique control edge 26. 0n its end remote from the longitudinal groove 16, the first oblique groove 24 is overlapped by a second oblique groove 28, which is offset along the piston's longitudinal axis toward the pump work chamber 9 and is defined on its side closer to the pump work chamber by a second oblique control edge 30. The transition between the first oblique control edge 26 and the second oblique control edge 30, whose slopes are different, is embodied by a shoulder 32 in the direction of the piston's longitudinal axis, which is disposed at the level of the transition between the first face-end control edge 14 and the second face-end control edge 18.

The sizing, position, and spacings of the control edges 14, 18, 20 and of the oblique control edges 20, 26 with respect to one another are shown in more detail in a developed view of the pump piston 1; as a supplement, the contour of the control opening 11 is also depicted in the drawing. The spacing between the first oblique control edge 26 and the face-end control edge 14 is chosen so that in the maximal supply quantity region that lies between them the spacing is larger than the span or the diameter of the control opening 11. On the other hand, the spacing between the second oblique control edge 30 and the second face-end control edge 18, in the region of the shoulder 32 is smaller than the diameter of the control opening 11, so that the control opening 11 in this rotational position of the pump piston 1 is already opened during its supply stroke by the second oblique control edge 30, before the second face-end control edge 18 has completely closed the control opening 11. The difference between the second face-end control edge 18 and the third control edge 20, as well as the slopes of the oblique control edges 26, 30 can be adjusted to meet the needs of each engine to be supplied.

With regard to its course of motion, the fuel injection pump according to the invention works in a known manner: During the intake stroke of the pump piston 1 in the direction of bottom dead center, fuel flows out of the low pressure chamber, and into the pump work chamber 9 via the control opening 11, which is uncovered by the face end 7 of the pump piston 1. Next, upon the ensuing supply stroke in the direction of top dead center, a small portion of the fuel in the pump work chamber 9 flows back into the low pressure chamber again via the control opening 11 until the face-end control edge 14, 18, 20 has overshot the upper control edge 10 of the control opening 11 and the pump piston 1 closes the control opening 11 with its jacket face. As the course of pump piston stroke continues, the fuel in the pump work chamber 9 is compressed, reaches the injection pressure, flows via an injection line (not shown) and an injection valve, and is injected into the combustion chamber of the engine to be supplied. With the overshooting of the oblique control edge 26, 30 past the lower control edge 12 of the control opening 11, the communication is opened between the low pressure chamber and the pump work chamber 9, which is under constant high pressure, so that the high pressure in the pump work chamber 9 decreases and the fuel flows out via the control opening into the low pressure chamber. The pressure in the injection system drops again to below the necessary injection pressure, and the injection valve closes.

Figure 2:
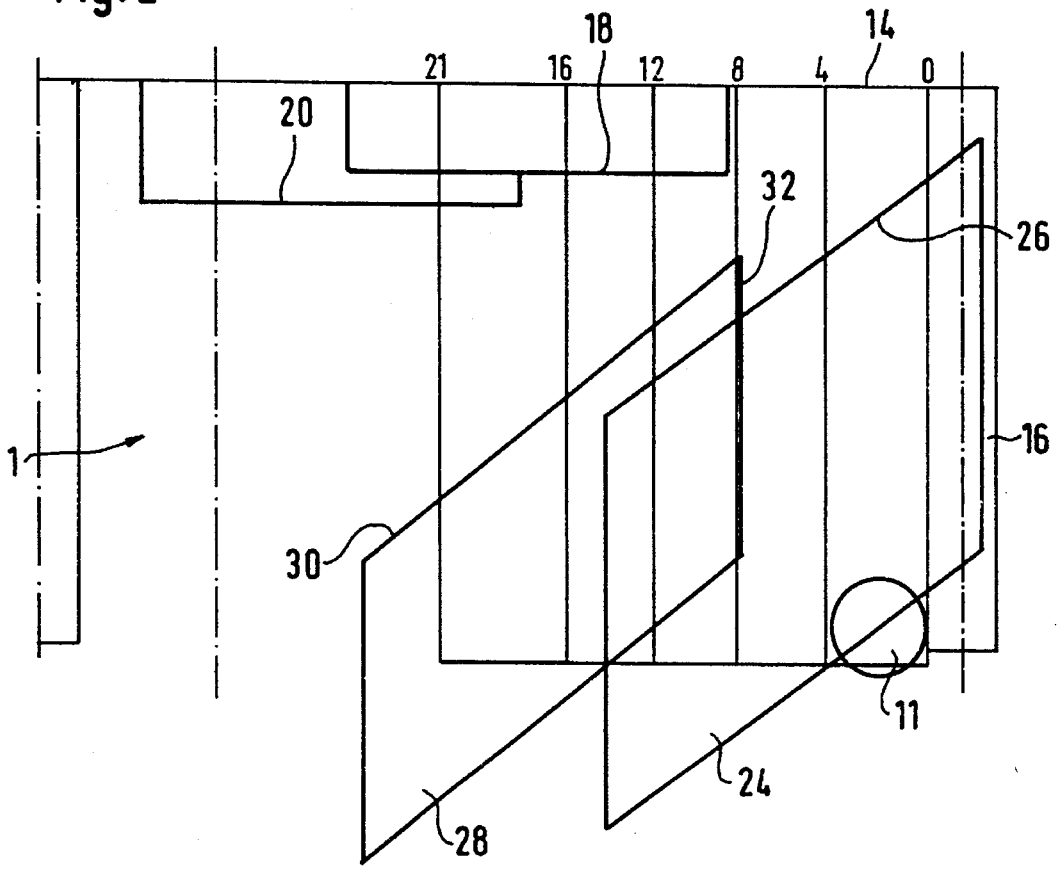
FIG. 2 shows a developed view of the pump piston having auxiliary control path lines and a depiction of the size of the control opening in the cylinder wall.
Figure 3:
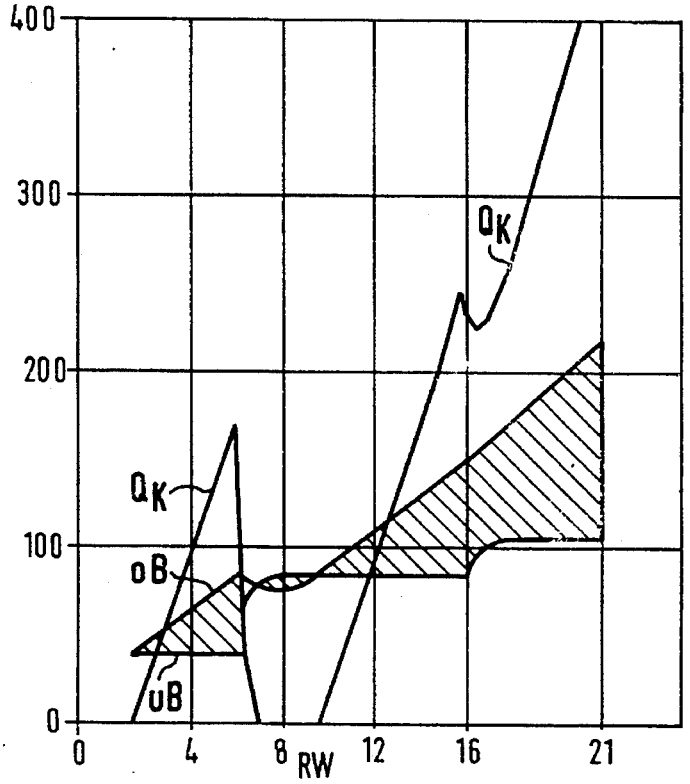
FIG. 3 shows a graph of the supply quantity and the useful stroke over the control path of the fuel injection pump according to the invention.

The time of the closing and opening of the control opening 11 and thus the onset and duration of the fuel supply and consequently the quantity of fuel injected can be controlled by means of the rotation of the pump piston; FIG. 3 serves to clarify this control process according to the invention by plotting the injection quantity Q and the useful stroke NH of the pump piston 1 over its control path RW (in mm). The control path RW of the pump piston 1, which corresponds to the torsional path, is on the abscissa of the graph, while the supply quantity Q (QK-characteristic curve of the injection quantity) and the useful stroke (shaded area) of the pump piston 1 are each plotted on the ordinate; furthermore, the control path lines are also drawn in FIG. 2. The boundary lines of the shaded area correspond to the local lines of the pump piston stroke, in which the control opening 11 is closed by means of the face-end control edges 14, 18, 20 (uB=lower boundary line) or at the end of the high pressure delivery is opened by means of the oblique control edge 26, 30 (oB=upper boundary line).

The control path position 0 corresponds to a zero supply quantity; that is, the control opening 11 continues to coincide with the longitudinal groove 16, so that high fuel pressure cannot build up in the pump work chamber 9, and as a result, both the useful stroke and the supply quantity amount to zero.

With rotation of the pump piston 1 by a set control path, the control opening 11 begins to emerge from its coincidence with the longitudinal groove 16; this is completely achieved at a control path of approximately 2 mm. From this point in time, the above-described supply process is achieved by means of the intermittent closing of the control opening 11 by means of the jacket face of the pump piston 1. As the length of the control path RW increases as a result of the rising distance between the control edge 14 and the oblique control edge 26 at a steady supply onset, the duration of this closing of the control opening 11 increases, and hence both the useful stroke NH and the supply quantity Q also steadily increase. This first control region corresponds to a very early supply onset, which is primarily necessary for a cold start of the engine to be supplied. As the control path region continues, at about 6 mm the control opening enters the coincidence region at the shoulder 32, causing a decrease in the useful stroke and the supply quantity again as a result of the shortening of the effective closing duration, until at about 7 mm, they reach zero again. In the control path region from 7 to about 9.5 mm, no closing of the control opening 11 takes place, as a result of the disposition of the control edges 18, 30 or of their distance from each other, so that during the supply stroke of the pump piston, the fuel in the pump work chamber 9 flows out via the control opening 11 into the low pressure chamber. At a control path position of about 9.5 mm, the useful stroke begins to increase once more, and consequently so does the supply quantity, as a result of the closing once again of the control opening 11; this can be ascribed, upon a further rotation of the pump piston 1, to the known fact that the distance between the control edge 18, which closes the control opening 11, and the oblique control edge 30, which opens it, is increasing. At about 18 mm along the control path, a transient kink in the otherwise steadily increasing useful stroke and supply quantity characteristic occurs, as a result of the transition from the second control edge 18 to the control edge 20 that makes a later supply onset possible.

The supply quantity Q can be inferred from the shaded area shown in FIG. 3; the lower line defining it is associated with the supply onset, and the upper boundary line is associated with the end of supply, so that the supply quantity is found from the distance between the two lines. The control path data on which the drawings and the description are based refer merely to the exemplary embodiment and can be changed as needed to fit those of the engine to be supplied.

With the embodiment and disposition of the control edges according to the invention, it is thus possible to shift the supply onset to "early" for cold starting, without restricting the usable control path on the pump piston.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines having a rotatable pump piston (1) axially guided in a cylinder bore (3) of a cylinder liner (5) and driven back and forth by a cam drive (40), said piston (1) with a face end (7) defines a pump work chamber (9) and which, on a jacket face, has a control opening (22) that communicates with the pump work chamber (9) and has an oblique control edge, said control edge cooperates with a control opening (11) in the wall of the cylinder liner (5) that leads from a low pressure chamber (2), wherein an edge of the face end (7) on the side of the pump piston (1) facing the pump work chamber (9), toward whose jacket face a first control edge (14) is formed that cooperates with the control opening (11) and that is defined on the piston circumference by means of a longitudinal groove (16) and, on its side remote from the longitudinal groove (16), has a second region, indented parallel with the piston's longitudinal axis toward the cam drive side of the pump piston (1), forming a second control edge (18), the second control edge (18) transitions into an additional region, which is indented toward the drive end of the pump piston (1), and which region, with the jacket face of the pump piston (1), forms a third control edge (20), and that the oblique control edge, beginning at the level of the face-end control edges (14, 18, 20) at the longitudinal groove (16) and dropping off as it continues, is divided into two control edges, of which a first oblique control edge (26) begins at the longitudinal groove (16) and, at the level of the transition between the first face-end control edge (14) and the second face-end control edge (18), transitions via a shoulder (32) along the piston's longitudinal axis toward the pump work chamber (9) into a second oblique control edge (30), wherein the spacing between the second oblique control edge (30), at its end associated with the first oblique control edge (26), and the second face-end control edge (18) is smaller than the span of the piston longitudinally of the the control opening (11) in the wall of the cylinder liner (5).

2. A fuel injection pump according to claim 1, in which the control recess (22) is embodied on the jacket face of the pump piston (1) by two oblique grooves (24, 28) offset from each other, and partially crisscrossing, whose edges, on the pump work chamber side, form the oblique control edges (26, 30), that rise along the circumference to the longitudinal groove (16) in the direction of the face end (7) of the pump piston.

3. A fuel injection pump according to claim 1, in which the oblique control edges (26, 30) have differing slopes.

4. A fuel injection pump according to claim 1, in which the second and third control edges (18, 20) lie in planes which are parallel to the plane of the face end (7).

5. A fuel injection pump according to claim 1, in which the second and third control edge (18, 20) extend obliquely to the radial plane of the pump piston (1) in the direction of the circumference.

* * * * *